US010378321B2

(12) United States Patent
Nelson et al.

(10) Patent No.: US 10,378,321 B2
(45) Date of Patent: Aug. 13, 2019

(54) BYPASS PLUNGERS INCLUDING FORCE DISSIPATING ELEMENTS AND METHODS OF USING THE SAME

(71) Applicant: Well Master Corporation, Golden, CO (US)

(72) Inventors: Daniel J. Nelson, Lakewood, CO (US); David Green, Highlands Ranch, CO (US); Stephen Wiese, Denver, CO (US)

(73) Assignee: Well Master Corporation, Golden, CO (US)

( * ) Notice: Subject to any disclaimer, the term of this patent is extended or adjusted under 35 U.S.C. 154(b) by 0 days.

(21) Appl. No.: 15/619,060

(22) Filed: Jun. 9, 2017

(65) Prior Publication Data

US 2017/0356276 A1 Dec. 14, 2017

Related U.S. Application Data

(60) Provisional application No. 62/348,663, filed on Jun. 10, 2016.

(51) Int. Cl.
*E21B 43/12* (2006.01)
*F04B 39/00* (2006.01)
(Continued)

(52) U.S. Cl.
CPC ..... *E21B 43/121* (2013.01); *F04B 39/0005* (2013.01); *F04B 47/12* (2013.01); *F04B 53/14* (2013.01)

(58) Field of Classification Search
CPC ..... E21B 43/121; F04B 39/0005; F04B 47/12
(Continued)

(56) References Cited

U.S. PATENT DOCUMENTS 1,922,396 A 8/1933 Ricker
2,276,109 A 3/1942 Smith
(Continued)

FOREIGN PATENT DOCUMENTS

GB 2051178 A 1/1981
WO 2006091634 A3 8/2006

OTHER PUBLICATIONS

Avallone, Eugene et al., Marks' Standard Handbook for Mechanical Engineers, 1987, pp. 3-58 to 3-59.
(Continued)

*Primary Examiner* — Taras P Bemko
(74) *Attorney, Agent, or Firm* — Faegre Baker Daniels LLP

(57) ABSTRACT

A plunger for oil and gas wells includes a shaft and a sleeve carried by the shaft. The sleeve defines a passageway located between a surface of the sleeve and a portion of the shaft, and the sleeve is longitudinally translatable relative to the shaft from a first configuration to a second configuration and vice versa. In the first configuration the plunger inhibits fluid flow through the passageway, and in the second configuration the plunger permits fluid flow through the passageway. The plunger further includes a force dissipating element interposed between the shaft and the sleeve. The force dissipating element at least partially dissipates forces caused by at least one of (1) the sleeve stopping relative to the shaft after translating from the first configuration to the second configuration; and (2) the sleeve stopping relative to the shaft after translating from the second configuration to the first configuration.

20 Claims, 7 Drawing Sheets

(51) Int. Cl.
*F04B 47/12* (2006.01)
*F04B 53/14* (2006.01)

(58) Field of Classification Search
USPC ..... 166/372
See application file for complete search history.

(56) References Cited

U.S. PATENT DOCUMENTS

| | | | | |
|---|---|---|---|---|
| 2,763,017 | A | 9/1956 | Redin | |
| 3,352,212 | A | 11/1967 | Read | |
| 3,856,082 | A | 12/1974 | Dinning | |
| 4,410,300 | A | 10/1983 | Yerian | |
| 4,467,879 | A | 8/1984 | Burge | |
| 4,487,263 | A | 12/1984 | Jani | |
| 4,502,843 | A | 3/1985 | Martin | |
| 4,554,130 | A | 11/1985 | Ecer | |
| 4,663,795 | A | 5/1987 | Neff | |
| 4,889,473 | A | 12/1989 | Krueger | |
| 5,253,713 | A | 10/1993 | Gregg et al. | |
| 5,427,504 | A | 6/1995 | Dinning et al. | |
| 5,518,072 | A | 5/1996 | McTernaghan | |
| 5,660,534 | A | 8/1997 | Snow | |
| 6,007,314 | A | 12/1999 | Nelson, II | |
| 6,038,725 | A | 3/2000 | Knapp | |
| 6,148,923 | A | 11/2000 | Casey | |
| 6,200,103 | B1 | 3/2001 | Bender | |
| 6,209,637 | B1 | 4/2001 | Wells | |
| 6,467,541 | B1 | 10/2002 | Wells | |
| 6,719,060 | B1 | 4/2004 | Wells | |
| 6,725,916 | B2 | 4/2004 | Gray et al. | |
| 6,971,856 | B1 | 12/2005 | Mayfield et al. | |
| 7,395,865 | B2 | 7/2008 | Bender | |
| 7,748,448 | B2 | 7/2010 | Bender | |
| 7,793,728 | B2 | 9/2010 | Bender | |
| 8,066,496 | B2 | 11/2011 | Brown | |
| 8,162,053 | B2 | 4/2012 | Green et al. | |
| 8,201,629 | B2 | 6/2012 | Green | |
| 8,448,710 | B1 | 5/2013 | Stephens | |
| 8,607,880 | B2 | 12/2013 | Smith et al. | |
| 8,863,837 | B2 | 10/2014 | Bender et al. | |
| 8,869,902 | B2 | 10/2014 | Smith et al. | |
| 9,121,269 | B2 | 9/2015 | Longfellow et al. | |
| 9,869,165 | B2 | 1/2018 | Hightower et al. | |
| 2003/0047316 | A1 | 3/2003 | Bosley | |
| 2005/0056416 | A1 | 3/2005 | Gray et al. | |
| 2005/0241819 | A1 | 11/2005 | Victor | |
| 2006/0054329 | A1 | 3/2006 | Chisholm | |
| 2006/0090893 | A1 | 5/2006 | Sheffield | |
| 2006/0102346 | A1 | 5/2006 | Casey | |
| 2006/0231247 | A1 | 10/2006 | Schneider et al. | |
| 2007/0267189 | A1 | 11/2007 | Wells | |
| 2008/0110617 | A1 | 5/2008 | Giacomino | |
| 2012/0285702 | A1 | 11/2012 | Rytlewski | |
| 2016/0017700 | A1* | 1/2016 | Roycroft | E21B 43/121 166/105 |
| 2016/0097265 | A1* | 4/2016 | Bishop | E21B 43/121 166/372 |
| 2016/0369595 | A1* | 12/2016 | Farrow | E21B 43/121 |
| 2017/0101856 | A1 | 4/2017 | Green et al. | |

OTHER PUBLICATIONS

Brush Plunger, Well Master Catalog, at least as of Jan. 24, 2000.
Solid Steel Plunger, Well Master Catalog, at least as of Jan. 24, 2000.
WSP020 Solid Steel Plunger Drawing, at least as of Jan. 24, 2000.

* cited by examiner

BYPASS PLUNGERS INCLUDING FORCE DISSIPATING ELEMENTS AND METHODS OF USING THE SAME

CROSS-REFERENCE TO RELATED APPLICATION

The present application claims the benefit of and priority to, under 35 U.S.C. § 119(e), U.S. Provisional Application Ser. No. 62/348,663, filed Jun. 10, 2016, entitled BYPASS PLUNGER INCLUDING FORCE DISSIPATING ELEMENTS, which is hereby incorporated by reference in its entirety for all purposes.

TECHNICAL FIELD

The present disclosure relates to plungers for lifting accumulating liquids from oil and gas wells. More specifically, the present disclosure relates to bypass plungers that permit fluid passage therethrough to reduce resistance to movement and increase speed when falling to the bottom of oil and gas wells.

BACKGROUND

Various devices and methods have been developed to remove accumulating liquids from oil and gas wells. One such device is a lift plunger, or simply a plunger, that is displaced within a well to lift accumulating liquids from the well. Plungers typically travel at high speeds in wells (for example, 1000 feet per minute or greater) and abruptly stop at the top and bottom of wells. As a result, plungers are subjected to relatively high forces that may cause rapid wear or damage in operation. These forces, and the resulting wear or damage, can be particularly problematic for bypass plungers, which include moveable components to permit fluid passage through the plungers to reduce resistance and increase plunger speed when falling to the bottom of wells. As a result, there is a continuing need for improvements to plungers.

SUMMARY

A plunger according to some embodiments of the present disclosure includes a shaft and a sleeve carried by the shaft. The sleeve defines a passageway located between a surface of the sleeve and a portion of the shaft, and the sleeve is longitudinally translatable relative to the shaft from a first configuration to a second configuration and vice versa. In the first configuration the plunger inhibits fluid flow through the passageway, and in the second configuration the plunger permits fluid flow through the passageway. The plunger further includes a force dissipating element interposed between the shaft and the sleeve. The force dissipating element at least partially dissipates forces caused by at least one of (1) the sleeve stopping relative to the shaft after translating from the first configuration to the second configuration; and (2) the sleeve stopping relative to the shaft after translating from the second configuration to the first configuration.

A method of using a plunger according to some embodiments of the present disclosure includes moving the plunger within the well while a sleeve occupies one of a first configuration and a second configuration relative to a shaft; translating the sleeve to the other of the first configuration and the second configuration relative to the shaft; stopping the sleeve in the other of the first configuration and the second configuration relative to the shaft; and at least partially dissipating forces caused by stopping the sleeve relative to the shaft via a force dissipating element.

BRIEF DESCRIPTION OF THE DRAWINGS

The accompanying drawings are incorporated into and form a part of the specification to illustrate several examples of the present disclosure, to include one or more inventions as described herein. These drawings, together with the description, explain the principles of the disclosure. The drawings simply illustrate preferred and alternative examples of how the disclosure may be made and used and are not to be construed as limiting the disclosure to only the illustrated and described examples. Further features and advantages will become apparent from the following, more detailed, description of the various aspects, embodiments, and configurations of the disclosure, as illustrated by the drawings referenced below.

Figure 1:
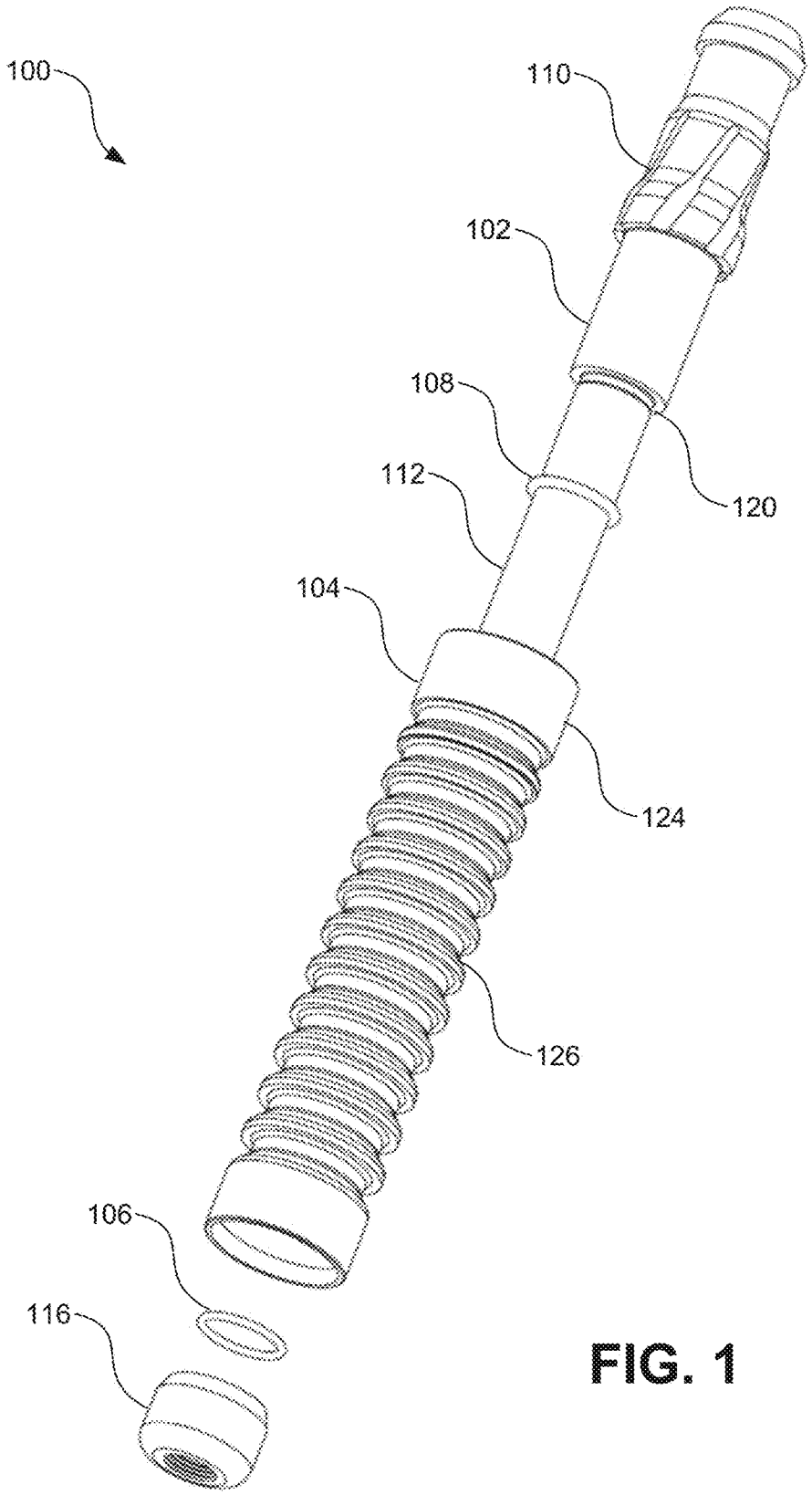
FIG. 1 is an exploded perspective view of an exemplary embodiment of a plunger according to the present disclosure.
Figure 2:
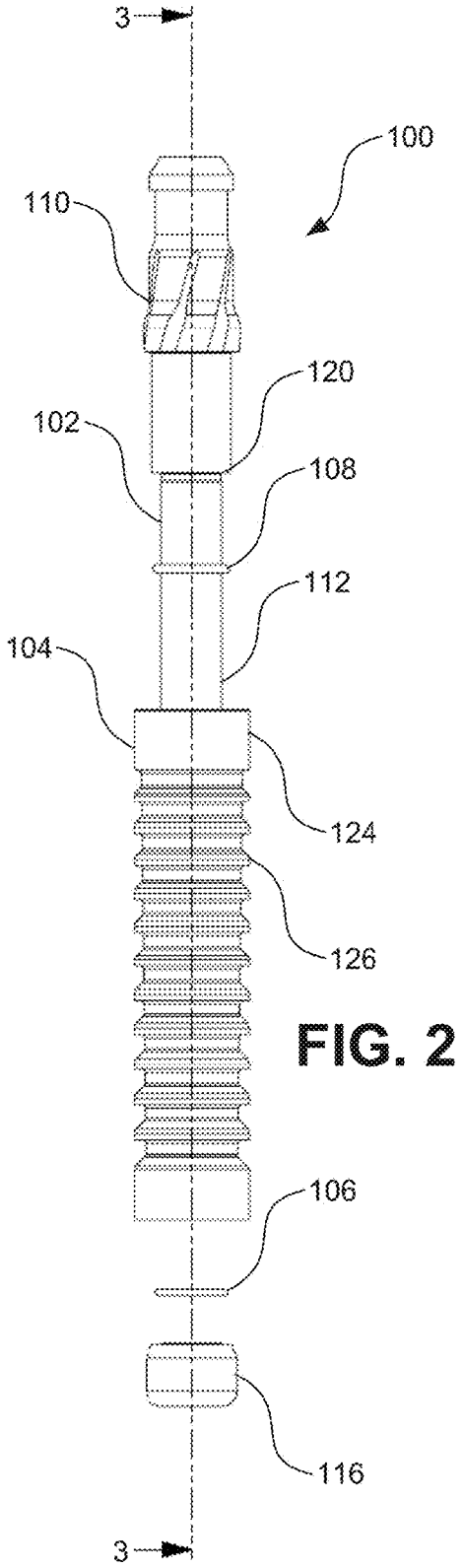
FIG. 2 is an exploded side view of the plunger of FIG. 1.

Corresponding reference characters indicate corresponding parts throughout the several views. It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Generally, this disclosure is directed to lift plungers that fall in a well, wherein the plungers incorporate one or more bypass ports. Such plungers further incorporate one or more force dissipating elements to reduce the effect of impact forces on plunger connections and components.

Referring to FIGS. 1-11, an exemplary embodiment of a bypass plunger 100 according to the present disclosure is shown. The bypass plunger 100 is adapted to be used in oil and gas wells to lift accumulated liquids therefrom. The plunger 100 generally includes a shaft 102, also referred to as a mandrel, that translatably carries a sleeve 104, also referred to as an outer member. The sleeve 104 translates longitudinally relative to the shaft 102 from a first configuration, also referred to as a "sleeve-down" configuration, (see FIGS. 4-7) to a second configuration, also referred to as a "sleeve-up" configuration, (see FIGS. 8-11) and vice versa. Generally, in the sleeve-up configuration, at least some amount of fluids pass through the plunger 100 to reduce resistance to movement of the plunger 100 in a well and thereby permit the plunger 100 to fall to the bottom of the well at a relatively high speed. Generally, in the sleeve-down configuration, fluids do not pass through the plunger 100 (or at least less fluids pass through the plunger 100 than when the plunger 100 is situated in the sleeve-up configuration) and the plunger 100 is thereby adapted to lift accumulated liquids from the well. The plunger 100 also includes one or more force dissipating elements (illustratively, two force dissipating elements 106, 108) that dissipate forces caused by abruptly stopping the sleeve 104 relative to the shaft 102 when moving the sleeve 104 from the first configuration to the second configuration and vice versa. These and other aspects of the plunger 100 are described in further detail below.

Figure 3:
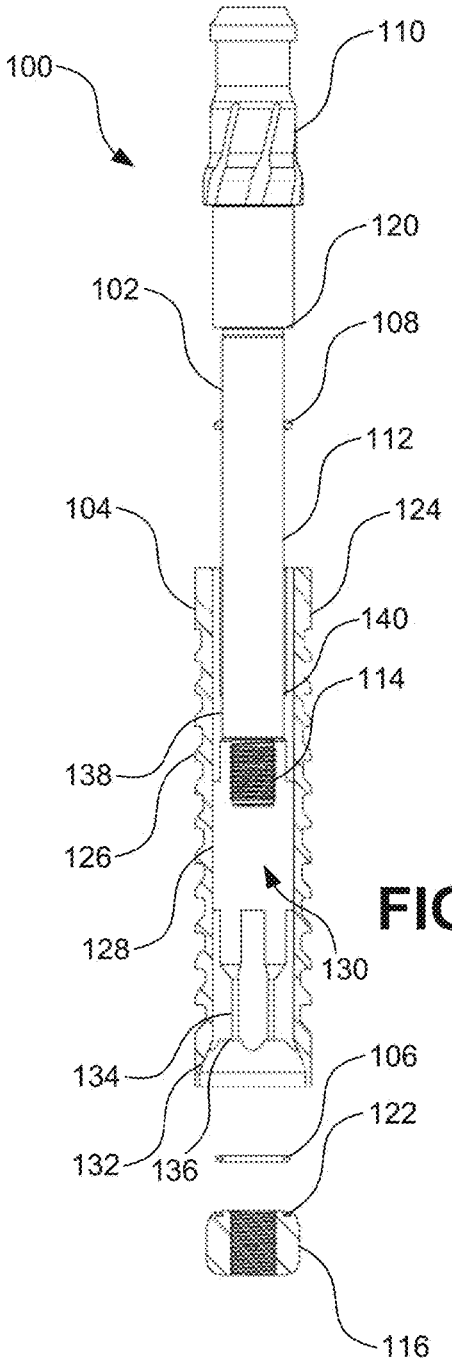
FIG. 3 is an exploded and partially sectioned side view of the plunger along line 3-3 of FIG. 2.
Figure 4:
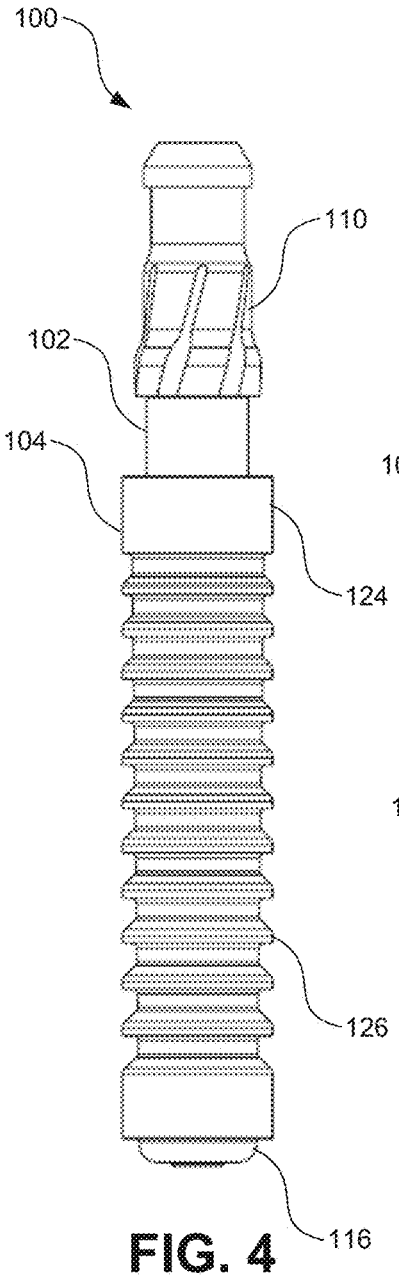
FIG. 4 is a side view of the plunger of FIG. 1 in a first configuration.
Figure 5:
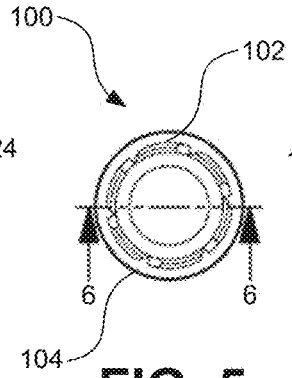
FIG. 5 is an end view of the plunger of FIG. 1 in the first configuration.
Figure 6:
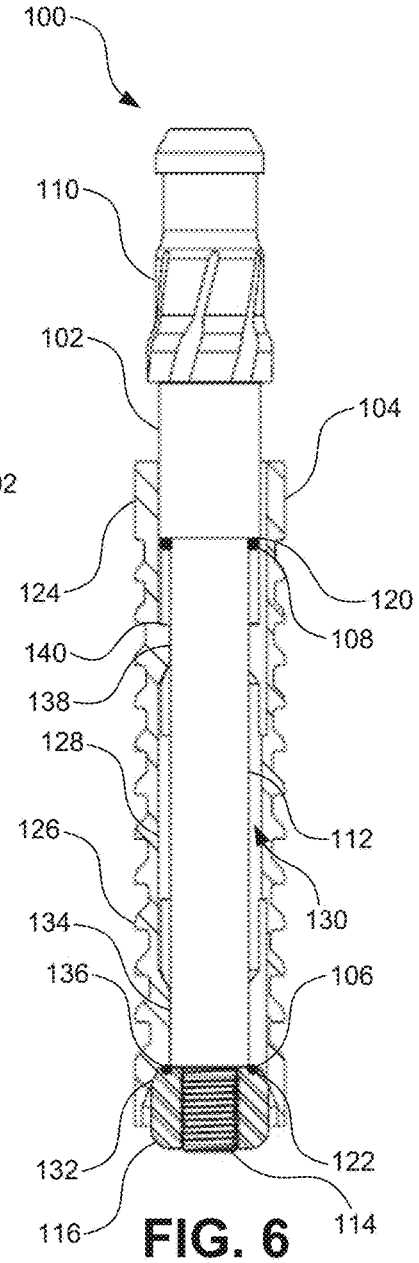
FIG. 6 is a partially sectioned side view of the plunger along line 6-6 of FIG. 5.
Figure 7:
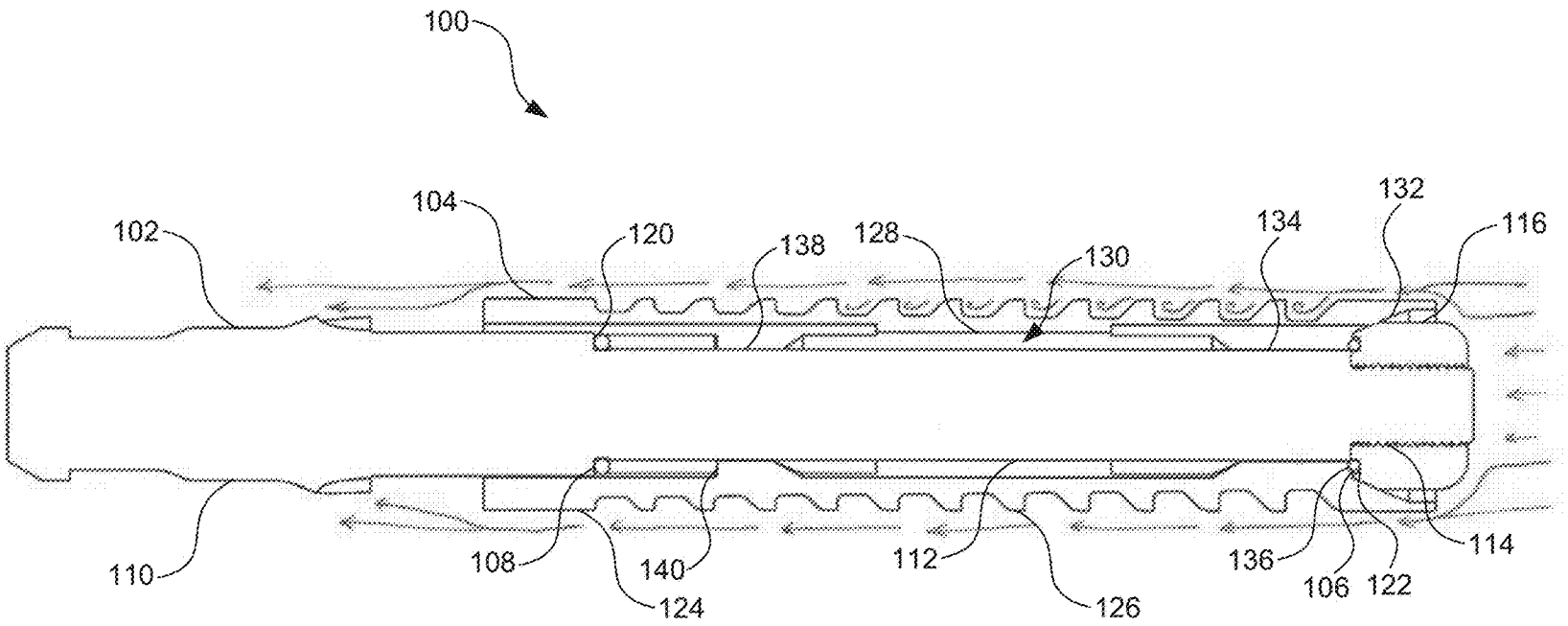
FIG. 7 is a sectioned side view of the plunger along line 6-6 of FIG. 5, and a flow path of liquid and gas relative to the plunger is illustrated.
Figure 8:
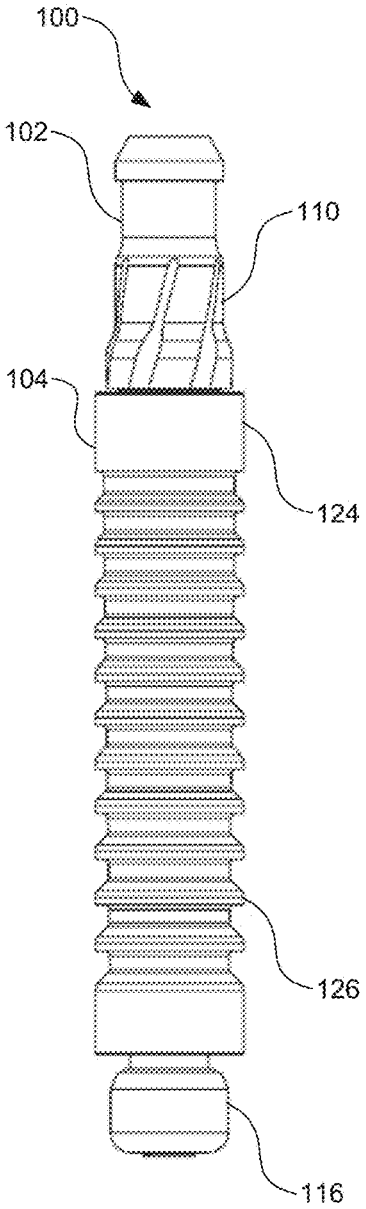
FIG. 8 is a side view of the plunger of FIG. 1 in a second configuration.
Figure 9:
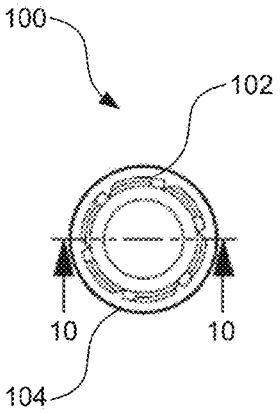
FIG. 9 is an end view of the plunger of FIG. 1 in the second configuration.
Figure 10:
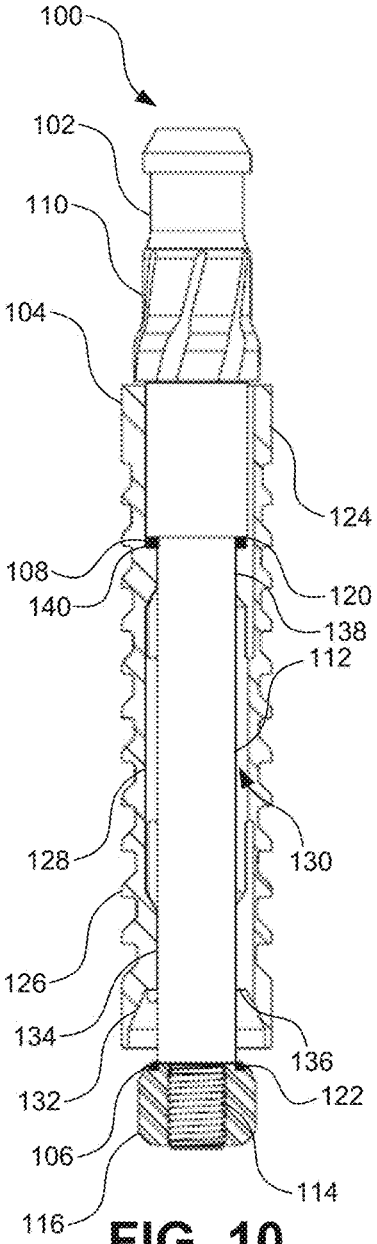
FIG. 10 is a partially sectioned side view of the plunger along line 10-10 of FIG. 9.
Figure 11:
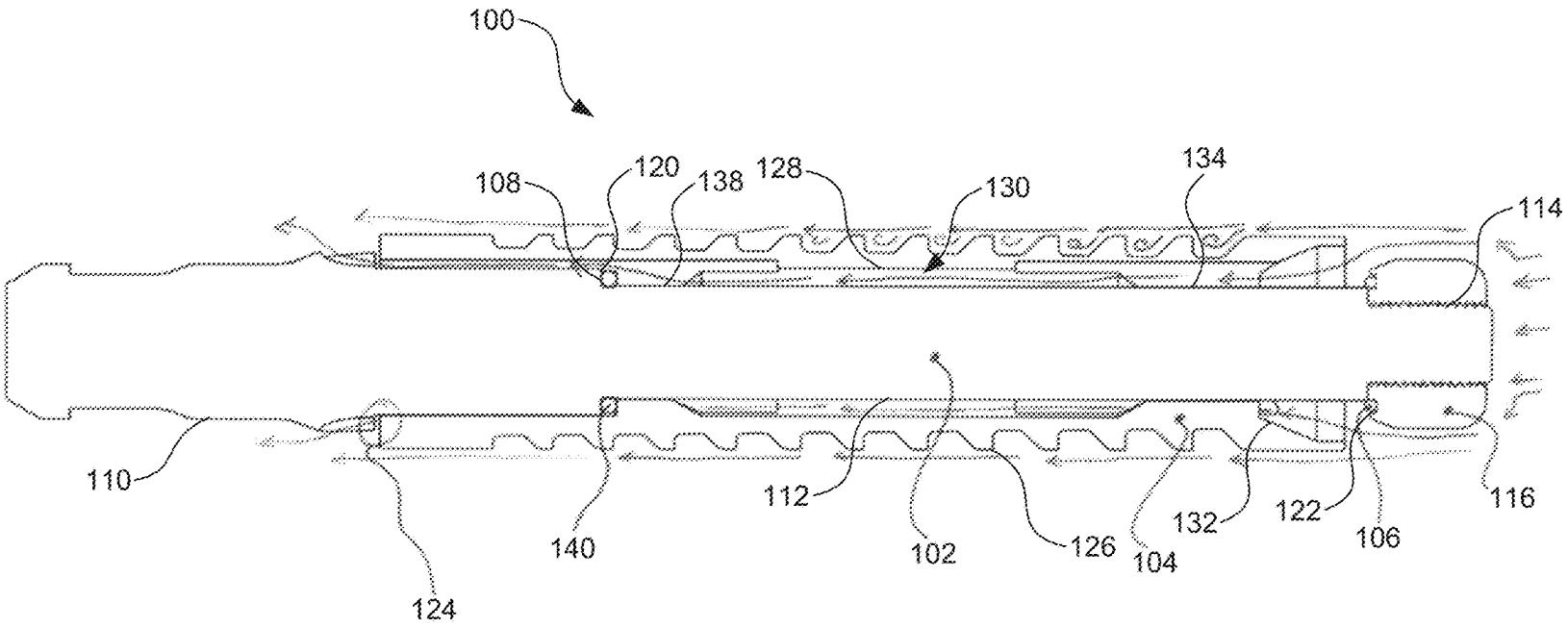
FIG. 11 is a sectioned side view of the plunger along line 10-10 of FIG. 9, and a flow path of liquid and gas relative to the plunger is illustrated.

As best seen in FIG. 3, the shaft 102 includes a head portion 110 that is adapted to engage a puck within a lubricator near the top of a well (not shown). In at least one embodiment, the head portion 110 is monolithically formed with a neck portion 112. The neck portion 112 may be disposed radially inwardly relative to the head portion 110. The neck portion 112 is monolithically formed with a foot portion 114 opposite the head portion 110. The foot portion 114 detachably couples to an end nut 116 (for example, via a threaded connection). In at least some well constructions, the end nut 116 is adapted to engage a spring bumper at the bottom of the well (not shown).

The force dissipating elements 106, 108 may each be annular components, such as "o-rings" as illustrated in the drawings. The force dissipating elements 106, 108 may each comprise one or more elastically deformable materials, such as elastomers. The force dissipating elements 106, 108 may be selected to include a material that has a durometer that is high enough to provide a spring-like action, but also soft enough to aid in providing a seal between the shaft 102 and the sleeve 104 in the sleeve-down configuration. Such a durometer may be in the range of about 70 A to about 90 A. As shown in the drawings, the first force dissipating element 106 may be carried by the end nut 116 within a recessed groove 122 that faces longitudinally toward the head portion 110. As shown in the drawings, the second force dissipating element 108 may be carried by the neck portion 112 of the shaft 102 and engage a shoulder surface 120 of the head portion 110 that faces longitudinally toward the foot portion 114.

The first force dissipating element 106 may be designed to compress in a range of (or provide a "slow down" length for the sleeve 104 in a range of) about 0.030 inches to about 0.050 inches. Such a compression range may be appropriate if the plunger 100 falls at a rate consistent with its coefficient of drag in typical well bore fluids (for example, approximately 60 feet per minute, and faster for wells that lack liquid at the bottom).

The second force dissipating element 108 may be designed to compress in a range of (or provide a slow down length for the sleeve 104 in a range of) about 0.050 inches to about 0.070 inches. Such a compression range may be appropriate if the plunger 100 ascends at a rate of approximately 800 feet per minute to 1000 feet per minute or even greater.

One or both of the force dissipating elements 106, 108 may have different structures, shapes, and/or may comprise different materials than those described above. For example, the second force dissipating element 108 could have a non-annular shape and could comprise an elastically deformable polymer foam.

Turning now to the sleeve 104, the sleeve 104 includes an outer surface 124 that illustratively includes a plurality of annular seal grooves 126. The annular seal grooves 126 may facilitate a fluid turbulence-generating and cleansing effect as the plunger 100 moves within the well. The sleeve 104 also includes an inner surface 128 opposite the outer surface 124. The inner surface 128 of the sleeve 104 is generally radially spaced apart from the neck portion 112 to define a passageway 130 within the plunger 100. The inner surface 128 of the sleeve 104 includes a tapered portion 132 that selectively sealingly engages the end nut 116 to selectively close the passageway 130. Stated another way, the sleeve 104 sealingly engages the end nut 116 in the sleeve-down configuration to inhibit fluid flow through the passageway 130 (see FIGS. 4-7), and the sleeve 104 is spaced apart from the end nut 116 in the sleeve-up configuration to permit fluid flow through the passageway 130 (see FIGS. 8-11).

As shown in the drawings, the inner surface 128 of the sleeve 104 may include a first plurality of radially inwardly-extending projections 134 adjacent to the tapering portion 132. Each of the radially inwardly-extending projections 134 includes a shoulder surface 136 that faces longitudinally toward the end nut 116. Each shoulder surface 136 engages the first force dissipating element 106 in the sleeve-down configuration.

As shown in the drawings, the inner surface 128 of the sleeve 104 may include a second plurality of radially inwardly-extending projections 138 proximate the head portion 110 of the shaft 102. Each of the radially inwardly-extending projections 138 includes a shoulder surface 140 that faces longitudinally toward the head portion 110. Each shoulder surface 140 engages the second force dissipating element 108 in the sleeve-up configuration.

The plunger 100 may operate as follows. The plunger 100 travels from the top of the well to the bottom of the well in the sleeve-up configuration (see FIGS. 8-11), and fluids flow through the passageway 130 of the plunger 100. Upon reaching the bottom of the well, the end nut 116 engages the spring bumper at the bottom of the well (not shown). This engagement and gravity cause the sleeve 104 to move to the sleeve-down configuration. The first force dissipating element 106 at least partially dissipates the forces caused by the sleeve 104 abruptly stopping relative to the shaft 102 when reaching the sleeve-down configuration (for example, the first force dissipating element 106 may dissipate the initial force "spike" when contacted by the sleeve 104). This in turn can reduce or eliminate potential damage to the sleeve 104 and/or shaft 102 due to such forces. In the sleeve-down configuration, fluids do not flow through the passageway 130 of the plunger 100, and all fluids are directed to the outside of the plunger 100 (that is, between plunger 100 and the tubing wall of the well). A valve at the top of the well is then opened (manually or automatically) and the plunger 100 begins to rise along with the gas and liquid in the well. The plunger 100 continues to rise in the well with the liquid and gas until the plunger 100 enters the lubricator at the surface (not shown). The head portion 110 of the shaft 102 engages the puck (not shown) within the lubricator, and the momentum of the sleeve 104 and fluid forces move the sleeve 104 into the sleeve-up configuration. The second force dissipating element 108 at least partially dissipates the forces caused by the sleeve 104 abruptly stopping relative to the shaft 102 when reaching the sleeve-up configuration (for example, the second force dissipating element 108 may dissipate the initial force spike when contacted by the sleeve 104; such forces are typically greater than those experienced when reaching the sleeve-down configuration). This in turn can reduce or eliminate potential damage to the sleeve 104 and/or shaft 102 due to such forces.

Figure 13:
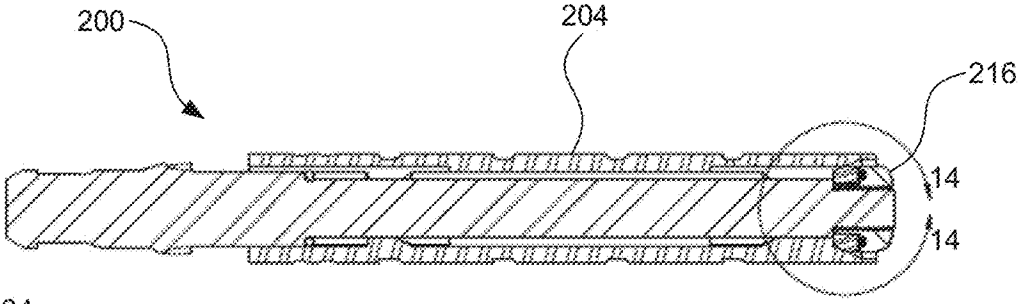
FIG. 13 is a sectioned side view of the plunger along line 13-13 of FIG. 12.
Figure 12:
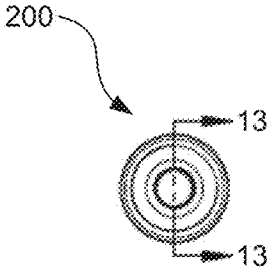
FIG. 12 is an end view of another exemplary embodiment of a plunger according to the present disclosure.
Figure 14:
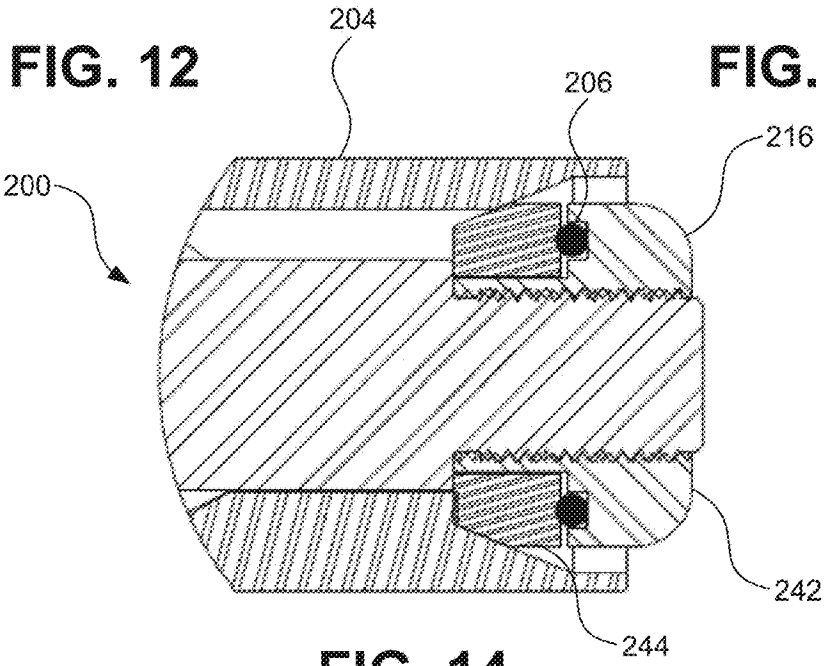
FIG. 14 is a detail side view of the plunger within line 14-14 of FIG. 13.

Referring to FIGS. 12-14, another exemplary embodiment of a plunger 200 according to the present disclosure is shown. The plunger 200 is identical to the plunger 100 described above, except the end nut 216 is provided as a multiple-piece structure that internally carries the first force dissipating element 206. Specifically, the end nut 216 includes a base 242 and detachable cover 244 that sealingly engages the sleeve 204 in the sleeve-down configuration. The first force dissipating element 206 engages both the base 242 and the cover 244 and is carried in a groove 246 formed on the base 242.

Various embodiments have been described, which are intended in all respects to be illustrative rather than restrictive. Alternative embodiments will become apparent to those of ordinary skill in the art to which the present invention pertains without departing from its scope. It will be understood that certain features and subcombinations are of utility and may be employed without reference to other features and subcombinations.

We claim:

1. A plunger for lifting accumulated liquids from a well, the plunger comprising:

a shaft;

a sleeve carried by the shaft, the sleeve defining a passageway located between a surface of the sleeve and a portion of the shaft, and the sleeve being longitudinally translatable relative to the shaft from a first configuration that inhibits fluid flow through the passageway to a second configuration that permits fluid flow through the passageway and vice versa; and a force dissipating element interposed between the shaft and the sleeve, the force dissipating element at least partially dissipating forces caused by at least one of (1) the sleeve stopping relative to the shaft after translating from the first configuration to the second configuration; and (2) the sleeve stopping relative to the shaft after translating from the second configuration to the first configuration, wherein the force dissipating element acts as a seal between the shaft and the sleeve to inhibit fluid flow through the passageway in the first configuration.

2. The plunger of claim 1, wherein the force dissipating element is a first force dissipating element that at least partially dissipates forces caused by the sleeve stopping relative to the shaft after translating from the second configuration to the first configuration, and further comprising a second force dissipating element interposed between the shaft and the sleeve, the second force dissipating element at least partially dissipating forces caused by the sleeve stopping relative to the shaft after translating from the first configuration to the second configuration.

3. The plunger of claim 2, wherein the first force dissipating element is configured to compress in a range of 0.030 inches to 0.050 inches.

4. The plunger of claim 3, wherein the second force dissipating element is configured to compress in a range of 0.050 inches to about 0.070 inches.

5. The plunger of claim 1, wherein the shaft comprises:

a head portion comprising a shoulder surface; and a neck portion coupled to the head portion at the shoulder surface;

wherein the force dissipating element is carried by the neck portion, and the force dissipating element engages the shoulder surface.

6. The plunger of claim 1, further comprising an end nut carried by the shaft, wherein the force dissipating element is carried by the end nut.

7. The plunger of claim 6, wherein the force dissipating element is a first force dissipating element that at least partially dissipates forces caused by the sleeve stopping relative to the shaft after translating from the second configuration to the first configuration, and further comprising a second force dissipating element interposed between the shaft and the sleeve, the second force dissipating element at least partially dissipating forces caused by the sleeve stopping relative to the shaft after translating from the first configuration to the second configuration.

8. The plunger of claim 7, wherein the shaft comprises:

a head portion comprising a shoulder surface; and a neck portion coupled to the head portion at the shoulder surface;

wherein the second force dissipating element is carried by the neck portion, and the second force dissipating element engages the shoulder surface.

9. The plunger of claim 1, wherein the force dissipating element is an o-ring.

10. The plunger of claim 1, wherein the force dissipating element comprises an elastically deformable material.

11. The plunger of claim 10, wherein the force dissipating element comprises an elastomer.

12. The plunger of claim 1, wherein the force dissipating element has a durometer in a range of 70 A to 90 A.

13. A method of using a plunger in a well, the plunger comprising a shaft, a sleeve carried by the shaft, the sleeve defining a passageway located between a surface of the sleeve and a portion of the shaft, and the sleeve being longitudinally translatable relative to the shaft from a first configuration that inhibits fluid flow through the passageway to a second configuration that permits fluid flow through the passageway and vice versa, and the plunger further comprising a force dissipating element interposed between the shaft and the sleeve, the method comprising:

moving the plunger within the well while the sleeve occupies one of the first configuration and the second configuration relative to the shaft;

translating the sleeve to the other of the first configuration and the second configuration relative to the shaft;

stopping the sleeve in the other of the first configuration and the second configuration relative to the shaft; and at least partially dissipating forces caused by stopping the sleeve relative to the shaft via the force dissipating element;

wherein the force dissipating element acts as a seal between the shaft and the sleeve to inhibit fluid flow through the passageway in the first configuration.

14. The method of claim 13, further comprising stopping the plunger at one of a top and a bottom of the well, and wherein longitudinally translating the sleeve relative to the shaft and stopping the sleeve relative the shaft are caused by stopping the plunger.

15. The method of claim 13, wherein moving the plunger within the well comprises lifting accumulated liquids in the well while the sleeve occupies the first configuration relative to the shaft.

16. The method of claim 13, wherein moving the plunger within the well comprises moving the plunger toward a bottom of the well while the sleeve occupies the second configuration relative to the shaft.

17. The method of claim 13, wherein the force dissipating element is a first force dissipating element, the plunger further comprising a second force dissipating element interposed between the shaft and the sleeve, and the method further comprising:

moving the plunger within the well while the sleeve occupies the other of the first configuration and the second configuration relative to the shaft;

translating the sleeve to the one of the first configuration and the second configuration relative to the shaft;

stopping the sleeve in the one of the first configuration and the second configuration relative to the shaft; and at least partially dissipating forces caused by stopping the sleeve in the one of the first configuration and the second configuration relative to the shaft via the second force dissipating element.

18. The method of claim 17, wherein moving the plunger within the well while the sleeve occupies one of the first configuration and the second configuration relative to the shaft comprises lifting accumulated liquids in the well while the sleeve occupies the first configuration relative to the shaft, and wherein moving the plunger within the well while the sleeve occupies the other of the first configuration and the second configuration relative to the shaft comprises moving the plunger toward a bottom of the well while the sleeve occupies the second configuration relative to the shaft.

19. A plunger for lifting accumulated liquids from a well, the plunger comprising:

a shaft;

a sleeve carried by the shaft, the sleeve defining a passageway located between a surface of the sleeve and a portion of the shaft, and the sleeve being longitudinally translatable relative to the shaft from a first configuration that inhibits fluid flow through the passageway to a second configuration that permits fluid flow through the passageway and vice versa;

a force dissipating element interposed between the shaft and the sleeve, the force dissipating element at least partially dissipating forces caused by at least one of (1) the sleeve stopping relative to the shaft after translating from the first configuration to the second configuration; and (2) the sleeve stopping relative to the shaft after translating from the second configuration to the first configuration;

an end nut carried by the shaft, wherein the force dissipating element is carried by the end nut, the end nut comprising:

a base; and a cover detachably coupled to the base, the force dissipating element being carried between the base and the cover.

20. A plunger for lifting accumulated liquids from a well, the plunger comprising:

a shaft comprising:

a head portion comprising a shoulder surface;

a neck portion coupled to the head portion at the shoulder surface;

a sleeve carried by the shaft, the sleeve defining a passageway located between a surface of the sleeve and a portion of the shaft, and the sleeve being longitudinally translatable relative to the shaft from a first configuration that inhibits fluid flow through the passageway to a second configuration that permits fluid flow through the passageway and vice versa;

a first force dissipating element interposed between the shaft and the sleeve, the first force dissipating element at least partially dissipating forces caused by the sleeve stopping relative to the shaft after translating from the second configuration to the first configuration; and a second force dissipating element interposed between the shaft and the sleeve, the second force dissipating element at least partially dissipating forces caused by the sleeve stopping relative to the shaft after translating from the first configuration to the second configuration, the second force dissipating element being carried by the neck portion, and the second force dissipating element engaging the shoulder surface.

* * * * *